US008033800B2

(12) United States Patent
Pan

(10) Patent No.: US 8,033,800 B2
(45) Date of Patent: Oct. 11, 2011

(54) BUILT-IN ELECTRIC AIR PUMP FOR INFLATABLE PRODUCT

(75) Inventor: Erjian Pan, Foshan Guangdong (CN)

(73) Assignee: Foshan Shunde Xinshengyuan Electrical Appliances Co., Ltd., Foshan Guangdong (CN)

( * ) Notice: Subject to any disclaimer, the term of this patent is extended or adjusted under 35 U.S.C. 154(b) by 387 days.

(21) Appl. No.: 12/464,623

(22) Filed: May 12, 2009

(65) Prior Publication Data

US 2010/0247355 A1 Sep. 30, 2010

(30) Foreign Application Priority Data

Mar. 24, 2009 (CN) ..... 2009 1 0038165

(51) Int. Cl.
*F04D 25/06* (2006.01)
*F04D 25/08* (2006.01)

(52) U.S. Cl. ..... 417/423.14; 417/234

(58) Field of Classification Search ..... 417/423.14, 417/366, 369–371, 234; 5/655.3, 713, 710, 5/706, 644, 654
See application file for complete search history.

(56) References Cited

U.S. PATENT DOCUMENTS 5,388,970 A * 2/1995 Muckelmann et al. ..... 417/363
5,457,846 A * 10/1995 Kuwano et al. ..... 15/339
6,036,456 A * 3/2000 Peters et al. ..... 417/423.3

FOREIGN PATENT DOCUMENTS

CN 101225825 A 7/2008

* cited by examiner

*Primary Examiner* — Karabi Guharay

(74) *Attorney, Agent, or Firm* — Robert P. Michal, Esq.; Lucas & Mercanti, LLP

(57) ABSTRACT

The present invention disclosed a built-in electric air pump for inflatable product, including a housing, a panel cover, an impeller, a motor, an intake, an air valve orifice, an air valve and an air passage part forming a motor chamber, an impeller chamber and an air passage in the housing, wherein an air passage directional chamber is formed by the air passage part, which is the junction of the air passage, the intake and the air valve orifice; an air passage directional valve is mounted within the air passage directional chamber; a motor chamber's air inlet is located on the wall of the air passage directional chamber; and the air passage directional valve has a heat dissipation and pressure release outlet which is used for pressure release, air exhaust and heat dissipation during the inflation process and used for drawing-in cool air from the environment during the deflation process. The present invention has a simple structure. A heat dissipation and pressure release outlet is arranged in the passage directional valve, which results in good heat dissipation and prevents the inflatable product from exploding as excess inflation pressure. Furthermore, the additional seal assembly with double leakproof function prevents the airbed inflated with air from leaking for a long time.

10 Claims, 6 Drawing Sheets

BUILT-IN ELECTRIC AIR PUMP FOR INFLATABLE PRODUCT

FIELD OF THE INVENTION

The present invention relates generally to an electric air pump, and more specially relates to a built-in electric air pump for the inflatable product.

BACKGROUND OF THE INVENTION

The inflatable product which are conveniently carried and easily kept are becoming more and more popular with consumers. Early inflatable product, for example inflatable furniture, has an air valve and was inflated or deflated by separate external inflation tools. As technical development, the inflatable product with built-in electric inflation/deflation device was present, to provide convenience for use. But the structural characteristic having the built-in air pump is usual to have a single air passage, which would cause insufficient heat dissipation to easy damage the air pump and have potential hazard. Further, the pressure would be continuously accumulated in the chamber of the inflatable products during the inflation process, so that the inflatable products are easy to explode as the excess inflation pressure.

To make heat dissipation and prevent the inflatable products from exploding as excess inflation pressure, Chinese patent application CN 200710026338.4 disclosed an inflatable product and electric inflation/deflation device thereof which make heat dissipation and pressure release automatically. Said electric inflation/deflation device has complicated structure and bad air tightness, the "automatic pressure release valve" of which is a static pressure balancing device and wouldn't be activated until the maximum pressure is reached. The valve would be a dynamic device when the inflatable product is being used, and the inflatable product would be deflated through the valve when it is pressed. The inflatable product, for example airbed would bear some pressure when it is in use, and the valve is always under pressure during the period, so that the sealability of said valve would be decreased and the capacity of responding to the maximum pressure of the valve would be also decreased, which will affect the normal use of the valve.

SUMMARY OF THE INVENTION

The purpose of the present invention is to provide a built-in electric air pump which possesses good air tightness and heat dissipation and prevents the inflatable products from exploding as excess inflation pressure.

In accordance with the present invention, a built-in electric air pump for inflatable product is provided, including a housing, a panel cover, an impeller, a motor, an intake, an air valve orifice, an air valve and an air passage part forming a motor chamber, an impeller chamber communicating with the motor chamber and an air passage communicating with the impeller chamber in the housing. An air passage directional chamber is formed by the air passage part, which is the junction of the air passage, the intake and the air valve orifice. An air passage directional valve is mounted within the air passage directional chamber, and a motor chamber's air inlet is located on the wall of the air passage directional chamber. The air passage directional valve has a heat dissipation and pressure release outlet which is used for pressure release, air exhaust and heat dissipation during the inflation process and used for drawing-in cool air from the environment during the deflation process.

The air passage directional chamber is a cylindrical chamber which communicates with the air passage, the intake, the air valve orifice and the motor chamber.

The air passage directional valve is a cylindrical valve which is associated with the cylindrical chamber, including upper and lower ends, a central rotating shaft and first and second passages which are located between the upper and lower ends and separated by a middle clapboard.

The upper end of the first passage has an air inlet/outlet which communicates with the intake.

The upper end of the second passage has a heat dissipation and pressure release outlet which communicates with the second passage and the intake and is used for pressure release, air exhaust and heat dissipation during the inflation process and used for drawing-in cool air from the environment during the deflation process.

A coniform sealing element, a barrier block, a positioning pole and a switch pressing element are mounted around the upper end of the air passage directional valve.

The lower end of the second passage has a convolute pushing element.

To obtain better sealability, the present invention may further includes an additional seal assembly.

The additional seal assembly includes a sealing cover and a sealing ring which are movably mounted on the intake.

The air valve which comprises an air valve sleeve, an air valve spring, an air valve pedestal, an air valve brace, a sealing strip and an air valve mesh enclosure, is mounted on the air valve orifice through an air valve sealing ring.

The present invention has a simple structure. A heat dissipation and pressure release outlet is arranged in the passage directional valve, which results in good heat dissipation and prevents the inflatable product from exploding as excess inflation pressure. Furthermore, the additional seal assembly and the air valve form a hermetic air chamber in the air pump of the present invention, with double leakproof function, so as to prevent the inflatable product that is inflated with air from leaking for a long time.

Figure 1:
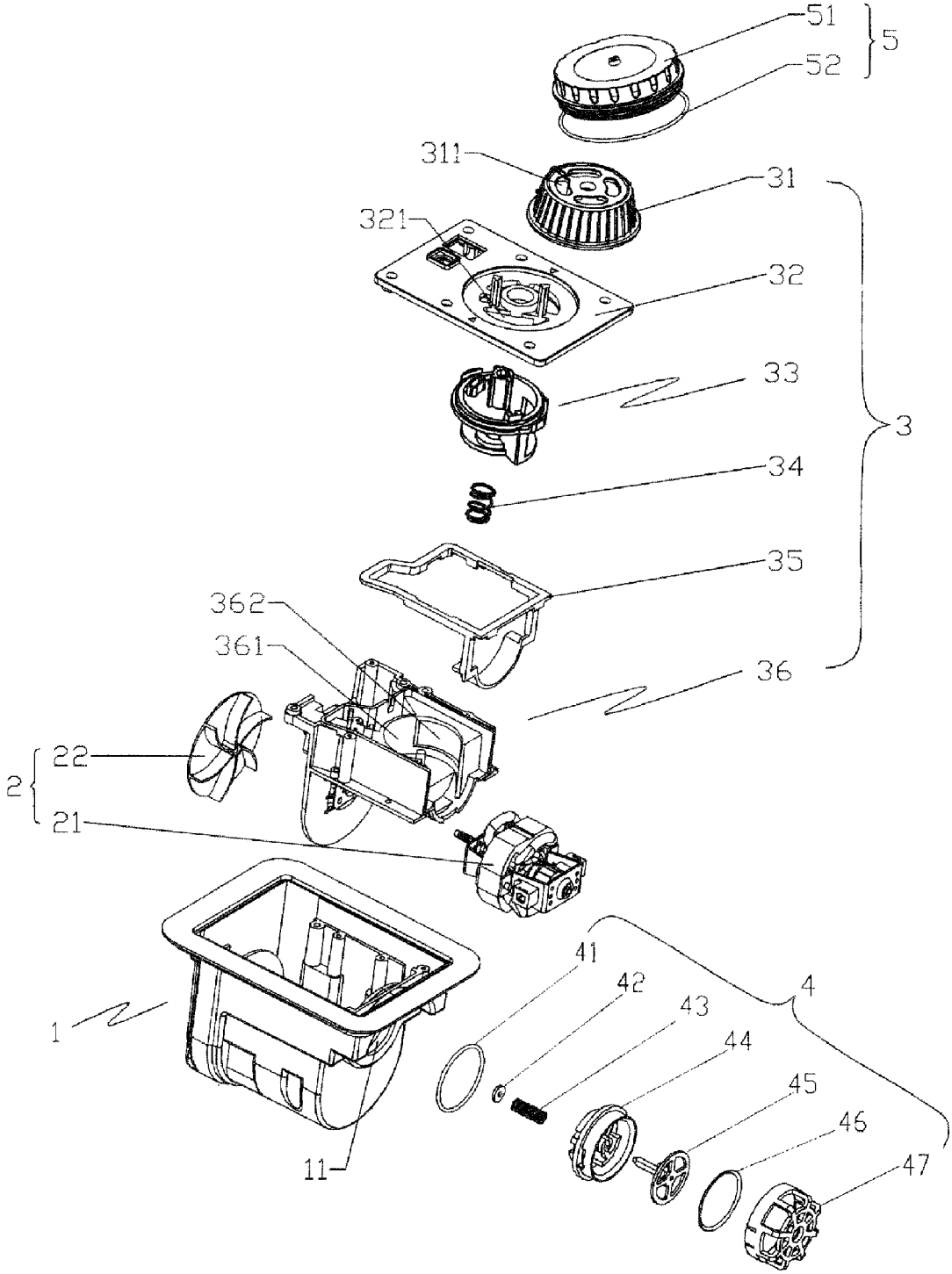
FIG. 1 is an exploded view of the air pump according to the first embodiment of the present invention.
Figure 2:
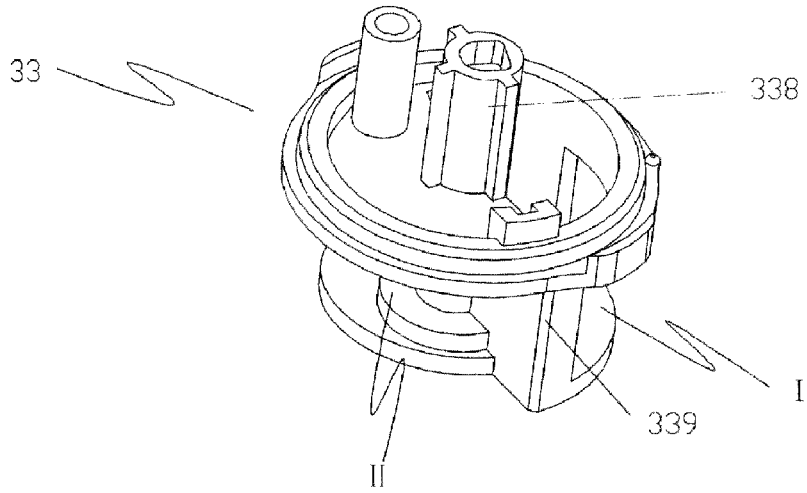
FIG. 2 is a schematic diagram of the structure of the air passage directional valve according to the first embodiment of the present invention, as seen from side.
Figure 3:
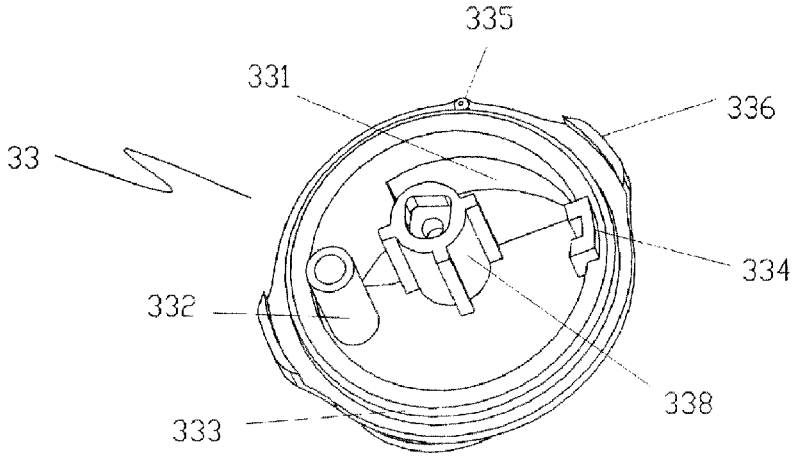
FIG. 3 is a schematic diagram of the structure of the air passage directional valve according to the first embodiment of the present invention, as seen from above.
Figure 4:
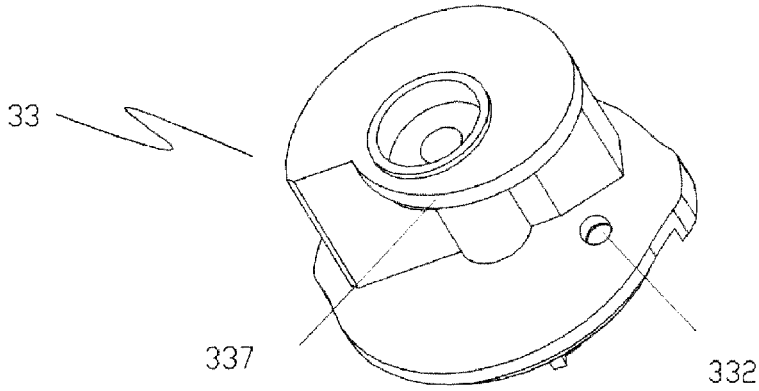
FIG. 4 is a schematic diagram of the structure of the air passage directional valve according to the first embodiment of the present invention, as seen from below.

Wherein:

1 represents a housing;
11 represents an air valve orifice;
12 represents a motor chamber;
13 represents an impeller chamber;
14 represents an air passage;
2 represents a fan;
21 represents a motor;
22 represents an impeller;
3 represents an air passage directional assembly;
31 represents a knob;
32 represents a panel cove;
33 represents an air passage directional valve;
34 represents a directional valve spring;
35 represents a gasket;
36 represents an air passage part;
311 represents a pylome;
312 represents an inclined circular pushing board;
321 represents an intake;
331 represents an air inlet/outlet;
332 represents a heat dissipation and pressure release outlet;
333 represents a coniform sealing element;
334 represents a barrier block;
335 represents a positioning pole;
336 represents a switch pressing element;
337 represents a convolute pushing element;
338 represents a central rotating shaft;
339 represents a middle clapboard;
361 represents an air passage directional chamber;
362 represents a motor chamber's air inlet;
4 represents an air valve;
41 represents an air valve sealing ring;
42 represents an air valve sleeve;
43 represents an air valve spring;
44 represents an air valve pedestal;
45 represents an air valve brace;
46 represents a sealing strip;
47 represents an air valve mesh enclosure;
5 represents an additional seal assembly;
51 represents a sealing cover; and
52 represents a sealing ring.

The present invention will be described further referring to the accompanying drawings and the embodiments.

DETAILED DESCRIPTION OF THE PREFERRED EMBODIMENTS

First Embodiment

Referring to the FIG. 1 to 6, the built-in electric air pump for inflatable product according to the present invention comprises a housing 1, a fan 2, an air passage directional assembly 3, an air valve 4 and an additional seal assembly 5.

The fan 2 which is mounted within the housing 1 comprises an impeller 22 and a motor 21.

An air valve orifice 11 is placed on the side of the housing 1. The air valve 4 which comprises an air valve sleeve 42, an air valve spring 43, an air valve pedestal 44, an air valve brace 45, a sealing strip 46 and an air valve mesh enclosure 47, is mounted on the air valve orifice 11 through an air valve sealing ring 41.

Figure 6:
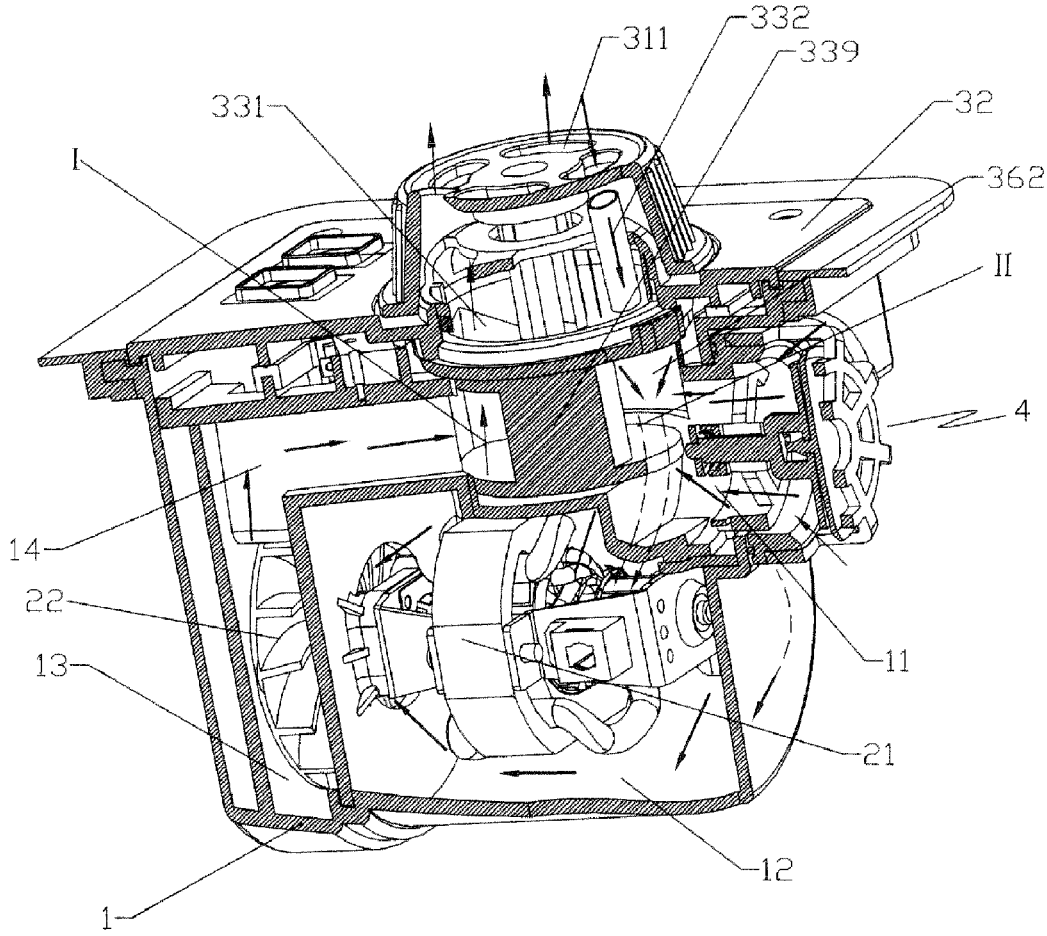
FIG. 6 is a schematic diagram of the structure of the air pump according to the first embodiment of the present invention which is in the deflation state.

The air passage directional assembly 3 comprises a knob 31, a panel cover 32, an air passage directional valve 33, a directional valve spring 34, a gasket 35 and an air passage part 36. The panel cover 32 which has an intake 321 is mounted on the housing 1. The knob 31 is mounted on the intake 321 and has a pylome 311. The air passage part 36 is mounted within the housing 1 and forms a motor chamber 12, an impeller chamber 13 communicating with the motor chamber 12 and an air passage 14 communicating with the impeller chamber 13 inside the housing 1. An air passage directional chamber 361 is formed by the air passage part 36, which is the junction of the air passage 14, the intake 321 and the air valve orifice 11. The air passage directional valve 33 is mounted within the air passage directional chamber 361, and a motor chamber's air inlet 362 is located on the wall of the air passage directional chamber 361. The air passage directional chamber 361 is a cylindrical chamber which communicates with the air passage 14, the intake 321, the air valve orifice 11 and the motor chamber 12. Further, referring to the FIG. 2 to 4, the air passage directional valve 33 is a cylindrical valve which is associated with the cylindrical chamber, including upper and lower ends, a central rotating shaft 338, first passage I and second passage II, said passages I and II are located between the upper and lower ends and separated by a middle clapboard 339. The upper end of the first passage I has an air inlet/outlet 331 which communicates with the intake 321. The upper end of the second passage II has a heat dissipation and pressure release outlet 332 which communicates with the second passage II and the intake 321 and is used for pressure release, air exhaust and heat dissipation during the inflation process and used for drawing-in cool air from the environment during the deflation process. The heat dissipation and pressure release outlet 332 works continuously during the inflation process or the deflation process. The heat dissipation and pressure release outlet 332 is just an air vent without any static pressure balancing device, the cross-sectional area of which is less than that of the air inlet/outlet 331, preferably, it is 1/10 to 1/2 of the area of the air inlet/outlet 331. In addition, a coniform sealing element 333, a barrier block 334, a positioning pole 335 and a switch pressing element 336 are mounted around the upper end of the air passage directional valve 33. The barrier block 334 is used for limiting the moving position in the inflation and deflation process. The positioning pole 335 is used for protecting the air passage directional valve 33 from shifting as the vibration of the air pump in the inflation and deflation process. The switch pressing element 336 is used for pressing the microswitch when the air pump will be controlled by a build-in microswitch therein instead of a wire control switch. The lower end of the second passage II has a convolute pushing element 337 which is used for pushing the air valve brace 45 to open the air valve 4 in the deflation process, in order to exhaust the air in the chamber of the inflatable product, as shown in FIG. 6. The air passage directional valve 33 and the air passage directional chamber 361 of the air passage part 36 are forced by the knob 31 and therefore move relative to each other, so that the air inlets/outlets of the air passage directional valve 33 and the air passage part 36 will be alternated to carry out the conversion of inflation and deflation.

To achieve better sealability, the present invention may further includes an additional seal assembly 5 which comprises a sealing cover 51 and a sealing ring 52 which are movably mounted on the intake 321. The sealing cover 51 is connected with the intake 321 of the panel cover 32 by screw thread or other screw mechanism so as to add a seal on the intake 321, the sealing cover 51 and the air valve 4 provide a seal function and a hermetic air chamber is formed thereby inside the air pump, the hermetic air chamber resists the pressure from the air chamber of the inflatable product and provides the inflatable product with excellent sealability, so that the appropriate air pressure thereof will be maintained.

The present invention will be described further referring to the concrete application principle.

The air pump of the present invention is an incorporate inflation-deflation equipment. The implementation of inflation and deflation is powered by the impeller driven by the motor. The conversion between the inflation and deflation is carried out by changing the tridimensional passage direction by the air passage directional valve. During the inflation process, excess air could be exhausted through the heat dissipation and pressure release outlet so as to achieve heat dissipation and pressure balance, while the deflation is processed, cool air could be drawn in from the environment through the heat dissipation and pressure release outlet to cool the motor, which ensure that the air pump can work under the appropriate working temperature of the motor for a long time during inflation and deflation, protect the impeller from melting, and protect the motor from damaging. In the static state, the air valve and the sealing cover are closed tightly and form a hermetic chamber inside the air pump, which results in excellent sealability.

Figure 5:
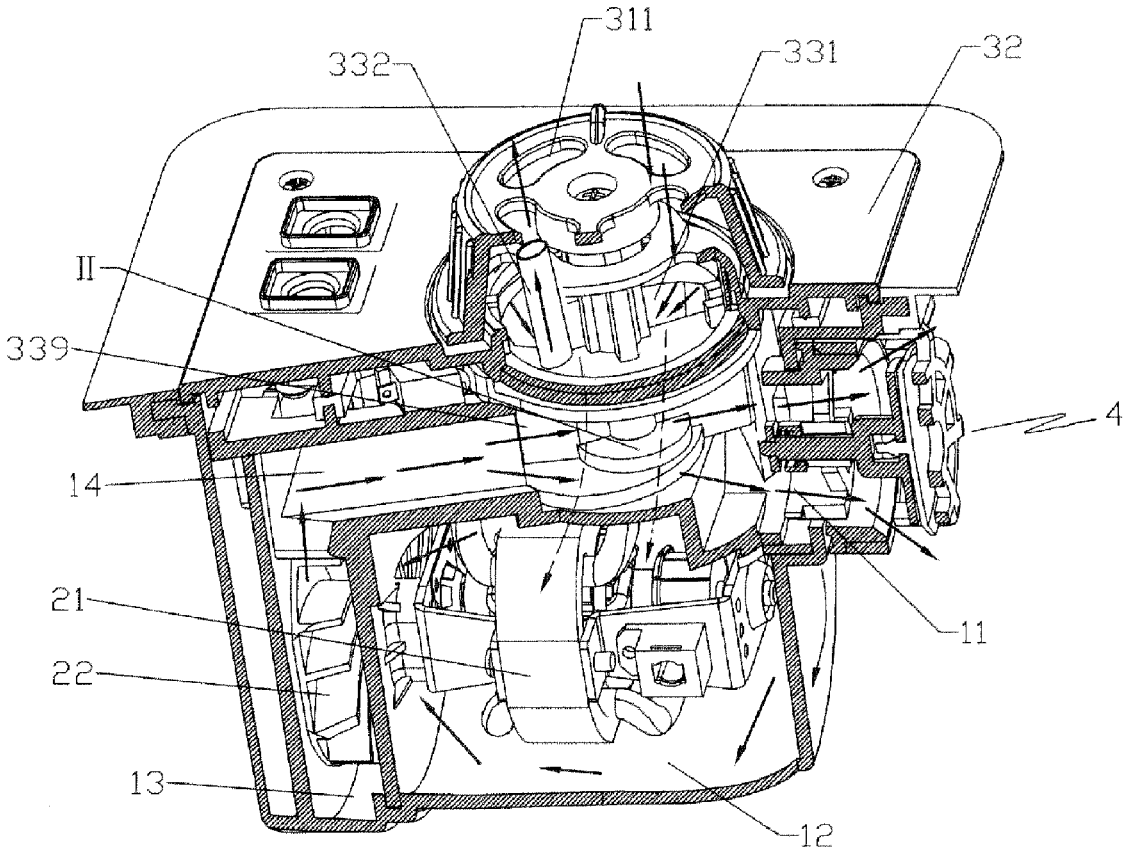
FIG. 5 is a schematic diagram of the structure of the air pump according to the first embodiment of the present invention which is in the inflation state.

Referring to the FIG. 5, in the inflation process, the sealing cover 51 is opened, the knob is turned to the inflation state, i.e. the air passage directional valve 33 is adjusted to the inflation state, so that the air inlet/outlet 331 of the first passage I of the air passage directional valve 33 which communicates with the intake 321 communicates with the motor chamber's air inlet 362, and the second passage II of the air passage directional valve 33 communicates with the air passage 14 and the air valve orifice 11. The air-drawing passage consisting of the intake 321, the first passage I and the motor chamber 12, and the inflation passage consisting of the air passage 14, the second passage II and the air valve orifice 11 are separated by the middle clapboard 339. The inflatable product is inflated by turning on the switch, after the inflation is done, the sealing cover is closed and the power supply is cut off. That is, during the inflation process, a chamber is formed within the housing 1 by the motor chamber 12, the air passage 14 and the impeller chamber 13, in which an air-compressing passage is formed under the act of the impeller 22 driven by the motor 21, such that the air is drawn in from the pylome 311 of the knob 31, goes through the intake 321 of the panel cover 32, the air inlet/outlet 331 of the first passage I of the air passage directional valve 33 and the motor chamber's air inlet 362, enters the motor chamber 12 where the motor is in, and then is compressed towards the air valve orifice 11 through the air passage 14 under the act of the impeller 22 driven by the motor 21 to inflate the inflatable product. While certain air pressure is achieved, the excess air is exhausted from the air pump through the heat dissipation and pressure release outlet 332 of the air passage directional valve 33, so as to keep good heat dissipation and pressure balance, protect the air pump from damaging, and protect the inflatable product from bearing overpressure, which extends service life of the air pump and the inflatable product.

Referring to the FIG. 6, in the deflation process, the sealing cover 51 is opened, the knob is turned to the deflation state, i.e. the air passage directional valve 33 is adjusted to the deflation state, so that the air inlet/outlet 331 of the first passage I of the air passage directional valve 33 which communicates with the intake 321 communicates with the air passage 14, the second passage II of the air passage directional valve 33 communicates with the motor chamber's air inlet 362 and the air valve orifice 11, and the air valve 4 is pushed and opened by the convolute pushing element 337 of the lower end of the second passage II of the air passage directional valve 33. The air-exhausting passage consisting of the intake 321, the first passage I and the air passage 14 and the air-drawing passage consisting of the motor chamber 12, the second passage II and the air valve orifice 11 are separated by the middle clapboard 339. The inflatable product is deflated by turning on the switch, after the deflation is done, the power supply is cut off. That is, during the deflation process, the motor 21 is started, such that the air inside the inflatable product is quickly exhausted from the air valve 4 under the act of the impeller 22, goes through the air valve orifice 11, the second passage II and the motor chamber's air inlet 362, and enters the motor chamber 12 to cool the motor 21. At the same time, under the act of sub-pressure, cool air is drawn from the environment into the motor chamber 12 through the heat dissipation and pressure release outlet 332 of the second passage II, the second passage II and the motor chamber's air inlet 362, which provides the motor 21 with good cooling effect. Then, the air inside the motor chamber 12 enters the impeller chamber 13 to be compressed by the impeller 22 and is exhausted through the air passage 14, the air inlet/outlet 331 of the first passage I and the intake 321, the mandatory exhaust will be implemented thereby. The further function of the heat dissipation and pressure release outlet 332 is to cool the motor 21 yet after the deflation is done. After the air inside the inflatable product is exhausted completely, new cool air is drawn into the air passage through the heat dissipation and pressure release outlet 332 again, then exhausted from the air pump through the air inlet/outlet 331 of the first passage, and so on to achieve good automatic heat dissipation of the motor 21 and assure the motor 21 working for a long time.

Second Embodiment

Referring to the FIG. 7 to 11, the built-in electric air pump for inflatable product according to the second embodiment has a structure different from that of the first embodiment, wherein the air passage directional valve 33 of the second embodiment is an lift-drop variety-position directional valve, while the air passage directional valve 33 of the first embodiment is a rotary variety-position directional valve. But above different structures provide the same performance.

The air pump according to the second embodiment comprises a housing 1, a fan, an air passage directional assembly, an air valve 4 and an additional seal assembly.

The fan which is mounted within the housing 1 comprises an impeller 22 and a motor 21.

An air valve orifice 11 is placed on the side of the housing 1. The air valve 4 is mounted on the air valve orifice 11 through an air valve sealing ring.

The air passage directional assembly comprises a knob 31, a panel cover 32, an air passage directional valve 33, a directional valve spring 34 and an air passage directional chamber 361. The panel cover 32 which has an intake 321 is mounted on the housing 1. The knob 31 is mounted on the intake 321 and has a pylome 311. An air passage part is mounted within the housing 1 and forms a motor chamber 12, an impeller chamber 13 communicating with the motor chamber 12 and an air passage 14 communicating with the impeller chamber 13 inside the housing 1. The air passage directional chamber 361 is formed by the air passage part, which is the junction of the air passage 14, the intake 321 and the air valve orifice 11.

Figure 12:
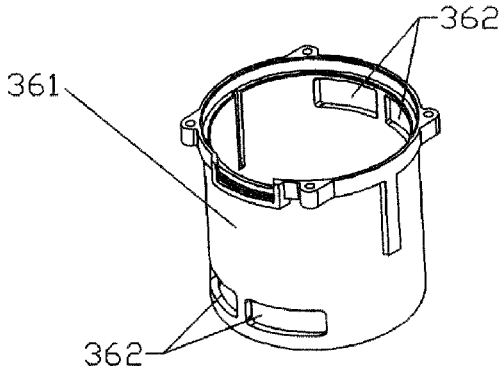
FIG. 12 is a schematic diagram of the structure of the air passage directional chamber according to the second embodiment of the present invention.

The air passage directional valve 33 is mounted within the air passage directional chamber 361, and four motor chamber's air inlets 362 are located on the wall of the air passage directional chamber 361, two are placed on the top of one side of the wall, and the other two are placed on the bottom of the opposite side of the wall, as shown in FIG. 12. Referring to the FIG. 9 to 11, the air passage directional valve 33 has a first passage I and a second passage II, and a pushing pole which is used for opening the air valve 4 is mounted on the lower end of the air passage directional valve 33. The first passage I communicates with the intake 321. The upper end of the second passage II has a heat dissipation and pressure release outlet 332 which communicates with the second passage II and the intake 321 and is used for pressure release, air exhaust and heat dissipation during the inflation process and used for drawing-in cool air from the environment during the deflation process. The heat dissipation and pressure release outlet 332 works continuously during the inflation process or the deflation process. The heat dissipation and pressure release outlet 332 is just an air vent without any static pressure balancing device. The air passage directional valve 33 has an inclined circular wall, the knob 31 has an inclined circular pushing board 312 which is associated with the inclined circular wall. The air passage directional valve 33 is pushed to move up or down by revolving the inclined circular pushing board 312, so as to alternate the air passage.

To achieve better sealability, the present invention may further includes an additional seal assembly (not shown) which comprises a sealing cover and a sealing ring which are movably mounted on the intake 321. The sealing cover is connected with the intake 321 of the panel cover 32 by screw thread or other screw mechanism so as to add a seal on the intake 321, the sealing cover and the air valve 4 provide a seal function and a hermetic air chamber is formed thereby inside the air pump, the hermetic air chamber resists the pressure from the air chamber of the inflatable product and provides the inflatable product with excellent sealability, so that the appropriate air volume thereof will be maintained.

The present invention will be described further referring to the concrete application principle.

Figure 7:
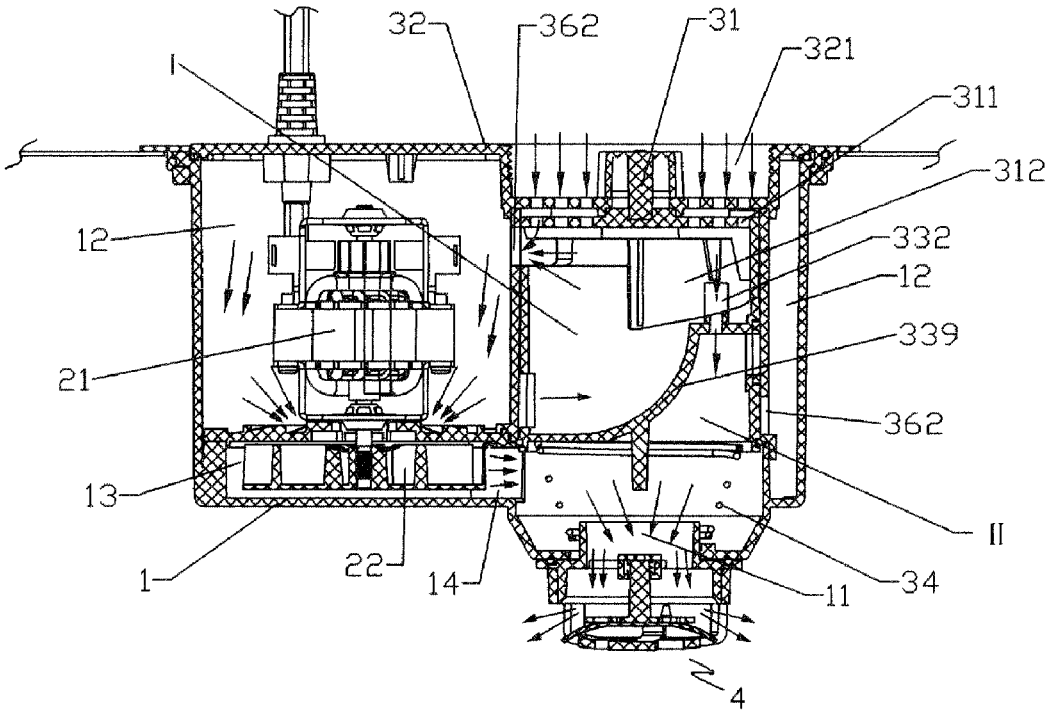
FIG. 7 is a sectional view of the air pump according to the second embodiment of the present invention which is in the inflation state.

Referring to the FIG. 7, in the inflation process, the sealing cover is opened, the knob is turned to the inflation state, i.e. the air passage directional valve 33 is adjusted to the upper inflation state, so that the first passage I of the air passage directional valve 33 which communicates with the intake 321 communicates with the upper motor chamber's air inlet 362, and the second passage II of the air passage directional valve 33 communicates with the air passage 14 and the air valve orifice 11. The air-drawing passage consisting of the intake 321, the first passage I and the motor chamber, and the inflation passage consisting of the air passage 14, the second passage II and the air valve orifice 11 are separated by a middle clapboard 339. The inflatable product is inflated by turning on the switch, after the inflation is done, the sealing cover is closed and the power supply is cut off. While certain air pressure is achieved, the excess air is exhausted from the air pump through the heat dissipation and pressure release outlet 332 of the air passage directional valve 33, so as to keep good heat dissipation and pressure balance, protect the air pump from damaging, and protect the inflatable product from bearing overpressure, which extends service life of the air pump and the inflatable product.

Figure 8:
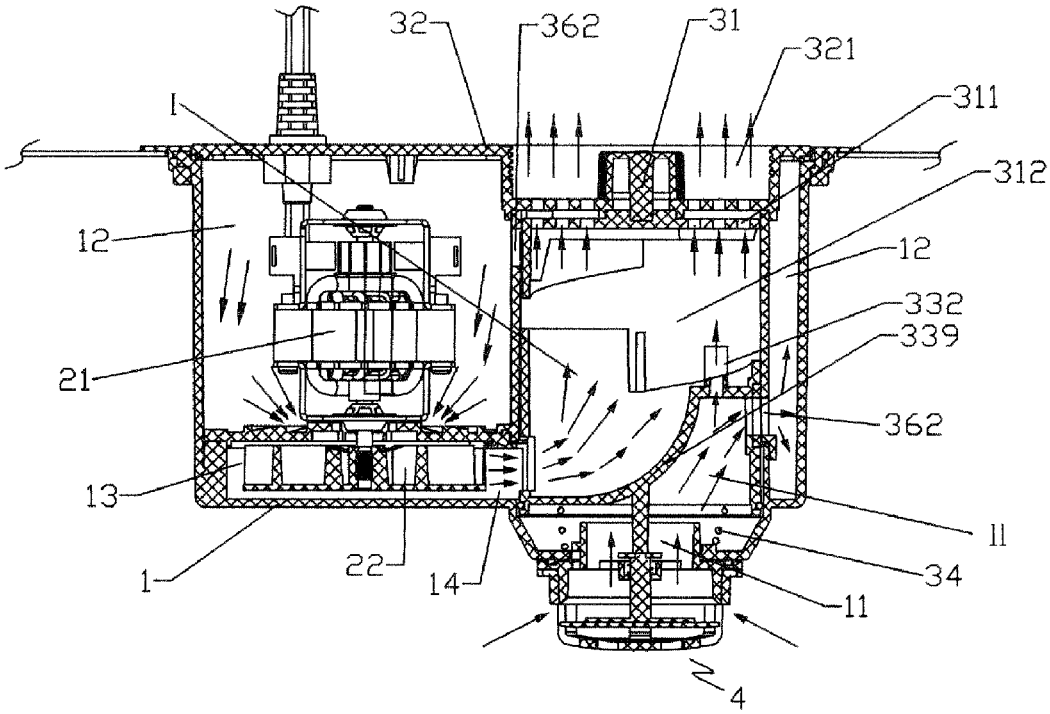
FIG. 8 is a sectional view of the air pump according to the second embodiment of the present invention which is in the deflation state.
Figure 9:
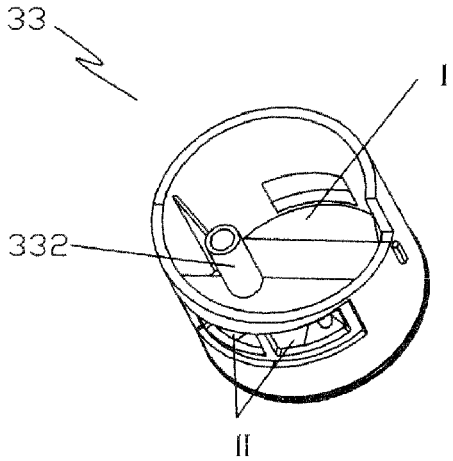
FIG. 9 is a schematic diagram of the structure of the air passage directional valve according to the second embodiment of the present invention, as seen from above.
Figure 10:
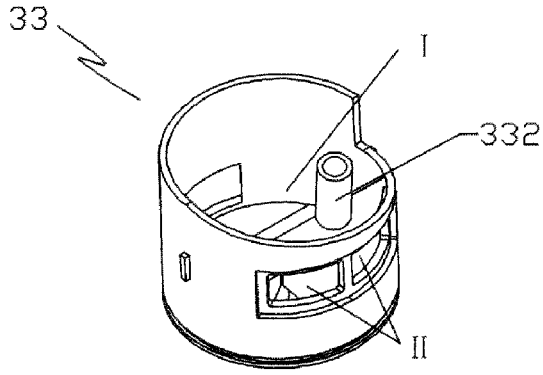
FIG. 10 is a schematic diagram of the structure of the air passage directional valve according to the second embodiment of the present invention, as seen from side.
Figure 11:
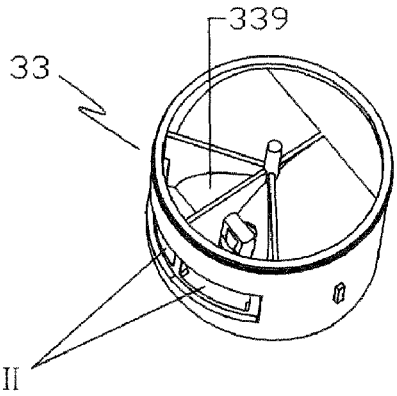
FIG. 11 is a schematic diagram of the structure of the air passage directional valve according to the second embodiment of the present invention, as seen from below.

Referring to the FIG. 8, in the deflation process, the sealing cover is opened, the knob is turned to the deflation state, i.e. the air passage directional valve 33 is pushed down to the deflation state, so that the first passage I of the air passage directional valve 33 which communicates with the intake 321 communicates with the air passage 14, the second passage II of the air passage directional valve communicates with the motor chamber's air inlet 362 and the air valve orifice 11, and the air valve 4 is pushed and opened by the pushing pole placed at the lower end of the air passage directional valve 33. The air-exhausting passage consisting of the intake 321, the first passage I and the air passage 14, and the air-drawing passage consisting of the motor chamber 12, the second passage II and the air valve orifice 11 are separated by a middle clapboard 339. The inflatable product is deflated by turning on the switch, after the deflation is done, the power supply is cut off. During the deflation process, cool air is drawn from the environment into the motor chamber 12 through the heat dissipation and pressure release outlet 332 of the second passage 11, the second passage II and the motor chamber's air inlet 362 which provides the motor 21 with good cooling effect. Then, the air inside the motor chamber 12 enters the impeller chamber 13 to be compressed by the impeller 22 and is exhausted through the air passage 14, the first passage I and the intake 321, the mandatory exhaust will be implemented thereby. The further function of the heat dissipation and pressure-release outlet 332 is to cool the motor 21 yet after the deflation is done. After the air inside the inflatable product is exhausted completely, new cool air is drawn into the air passage through the heat dissipation and pressure release outlet 332 again, then exhausted from the air pump through the inlet/outlet 331 of the first passage, and so on to achieve good automatic heat dissipation of the motor 21 and assure the motor 21 working for a long time.

The air pump of the present invention uses a heat dissipation and pressure release outlet and allows the air flows through the same, to optimize the heat dissipation effect and the pressure balance system. The function of the pressure balance system is carried out by the movement of the air pump, which must associate with the heat dissipation and pressure release outlet. When the air pump is in the static state, the sealing strip separates the chamber of the air pump from the chamber of the inflatable product, said two chambers become the respective hermetic chambers, and the heat dissipation and pressure release outlet is no longer used for balancing the pressure. Furthermore, the air pump becomes a hermetic device after the sealing cover is in close position, so as to provide the inflatable product with stable pressure during the use.

Compared with the present complicated pressure release valve, the heat dissipation and pressure release outlet of the present invention costs less, but provides better effect. Heat dissipation and pressure balance is achieved by the two-way air flow passage. During the inflation process, the heat dissipation and pressure release outlet is an air-exhausting passage, which allows heat air out continually for heat dissipation, and the pressure saturation is equal to the output pressure of the air pump.

The present pressure release valve has a complicated structure and high cost. The valve does not work until the pressure saturation is reached, which results in bad heat dissipation effect. In addition, the pressure saturation of the valve is easily affected by the environmental air pressure.

It is to be understood that the present invention includes but is not limited to the disclosed embodiments. The scopes of the appended claims encompass all the modifications and the equivalents which are apparent to those skilled in the art.

What is claimed is:

1. Built-in electric air pump for inflatable products, including a housing, a panel cover, an impeller, a motor, an intake, an air valve orifice, an air valve and an air passage part forming a motor chamber, an impeller chamber communicated with said motor chamber and an air passage communicated with said impeller chamber in said housing, wherein an air passage directional chamber is formed by said air passage part, which is the junction of said air passage, said intake and said air valve orifice; an air passage directional valve is mounted within said air passage directional chamber; a motor chamber's air inlet is located on the wall of said air passage directional chamber; and said air passage directional valve has a heat dissipation and pressure release outlet which is used for pressure release, air exhaust and heat dissipation during the inflation process and used for drawing-in cool air from the environment during the deflation process.

2. Built-in electric air pump according to claim 1, wherein said air passage directional chamber is a cylindrical chamber which communicates with said air passage, said intake, said air valve orifice and said motor chamber.

3. Built-in electric air pump according to claim 2, wherein said air passage directional valve is a cylindrical valve which is associated with said cylindrical chamber, including upper and lower ends, a central rotating shaft and first and second passages which are located between the upper and lower ends and separated by a middle clapboard.

4. Built-in electric air pump according to claim 3, wherein the upper end of said first passage has an air inlet/outlet which communicates with said intake.

5. Built-in electric air pump according to claim 3, wherein the upper end of said second passage has a heat dissipation and pressure release outlet which communicates with said second passage and said intake and is used for pressure release, air exhaust and heat dissipation during the inflation process and used for drawing-in cool air from the environment during the deflation process.

6. Built-in electric air pump according to claim 3, wherein a coniform sealing element, a barrier block, a positioning pole and a switch pressing element are mounted around the upper end of said air passage directional valve.

7. Built-in electric air pump according to claim 3, wherein the lower end of said second passage has a convolute pushing element.

8. Built-in electric air pump according to claim 1, further including an additional seal assembly.

9. Built-in electric air pump according to claim 8, wherein said additional seal assembly includes a sealing cover and a sealing ring which are movably mounted on said intake.

10. Built-in electric air pump according to claim 1, wherein said air valve which comprises an air valve sleeve, an air valve spring, an air valve pedestal, an air valve brace, a sealing strip and an air valve mesh enclosure, is mounted on said air valve orifice through an air valve sealing ring.

* * * * *